US005358623A

United States Patent [19]

Bibber

[11] Patent Number: 5,358,623

[45] Date of Patent: Oct. 25, 1994

[54] CORROSION RESISTANT ANODIZED ALUMINUM

[75] Inventor: John W. Bibber, Batavia, Ill.

[73] Assignee: Sanchem, Inc., Chicago, Ill.

[21] Appl. No.: 50,841

[22] Filed: Apr. 21, 1993

[51] Int. Cl.[5] ..... C23F 11/18; C23C 22/66

[52] U.S. Cl. ..... 205/201; 205/203; 205/204; 148/272; 106/14.21

[58] Field of Search ..... 106/14.21; 148/272; 205/201, 204, 203

[56] References Cited

U.S. PATENT DOCUMENTS 1,971,240 8/1934 Tosterud ..... 148/272
1,988,012 1/1935 Mason ..... 148/272
4,755,224 7/1988 Bibber ..... 106/14.21
4,878,963 11/1989 Bibber ..... 106/14.21

*Primary Examiner*—Sam Silverberg
*Attorney, Agent, or Firm*—Laff, Whitesel, Conte & Saret

[57] ABSTRACT

A method of protecting a non-chromium anodized aluminum or aluminum alloy by rinsing the anodized aluminum or aluminum alloy with warm water to warm the anodized aluminum or aluminum alloy, coating the warm anodized aluminum or aluminum alloy with, a non-chromium alkali metal permanganate solution having a pH in the range of about 4.0 to about 8.0, and a temperature of from about 170° F. to about 212° F., and forming a non-chromium mixed metal oxide coating of aluminum and manganese oxides on the anodized aluminum or aluminum alloy.

7 Claims, No Drawings

CORROSION RESISTANT ANODIZED ALUMINUM

The present invention relates to a method of treating anodized aluminum and aluminum alloys with a non-chromium corrosion resistant coating and to the articles produced thereby.

BACKGROUND OF THE INVENTION

Aluminum and aluminum alloys have been made corrosion resistant by providing a non-chromium conversion coating thereon as disclosed in our U.S. Pat. Nos. 4,755,224; 4,711,667; 4,895,608 and 4,988,396. These patents are generally related to aluminum conversion coatings and although they broadly cover aluminum coatings they do not specifically disclose protecting anodized aluminum and/or aluminum alloys.

Aluminum metal and it's alloys are in many cases anodized or given an oxide film of controlled thickness in order to enhance corrosion resistance, and or paint adhesion. Additional corrosion resistance is necessary as the anodized oxide film is quite porous and thus allows the underlining metal to be exposed to corrosive agents.

Additional corrosion resistance is supplied by a process known as sealing. One of the earliest and still most widely used process, seals the surface by hydrating the oxide film in boiling water or steam. (Setah, S. and Mitays, A. *Proc. World Engineering Congress*, Tokay 1929) This causes it to swell and thus close off the surface to corrosive agents. Still other early methods involved converting the oxide film to aluminum silicate solution U.S. Pat. No. 1,746,153 and British Patent 393,996 (1931) with a hot silicate, filling the pores with cobalt or nickel hydroxide, (Speiser, C. T., *Electroplating and Metal Finishings,* 1956, 9, No. 4, 109–16, 128) and for maximum corrosion resistance U.S. Pat. No. 1,946,162, hydrating the oxide film in order to seal in a hexavalent chromate solution.

However, the hexavalent chromium compositions are highly toxic and spent chromium compositions provide ecological problems.

SUMMARY OF THE INVENTION

Our invention eliminates some of the problems of hexavalent chromium and other heavy metal compositions by a non-chromium permanganate composition which is used to seal and provide an intermediate protective composition on anodized aluminum and/or aluminum alloys.

Therefore, it is an object of the present invention to provide an anodized aluminum or aluminum alloy comprising an anodized aluminum or aluminum alloy coated with a non-chromium mixed metal oxide coating of manganese and aluminum oxides.

It is still another object of the present invention to provide aluminum or aluminum alloy with a protective coating comprising cleaning said aluminum or aluminum alloy, anodizing the cleaned aluminum or aluminum alloy, contacting the anodized aluminum or aluminum alloy with a non-chromium permanganate solution containing at least 0.15% by weight of alkali metal permanganate, a pH range of about 4 to about 8, and a temperature of about 170° F. to the boiling point of the solution to provide a protective coating of mixed oxides of aluminum and manganese.

In our method, we treat the anodized aluminum and/or aluminum alloy with a non-chromium alkali metal permanganate solution having a pH of from about 4 to about 8. The Alkali metal is selected from potassium, sodium or lithium. The preferred alkali metal permanganate is sodium or potassium permanganate.

The alkali metal permanganate compositions may be applied in any acceptable manner (i.e., immersion, spraying, misting or spreading by an appropriate applicator). The anodized aluminum or aluminum alloy surface is normally immersed in my aqueous alkali metal permanganate solution having a concentration of about 0.15 to about 0.60% by weight alkali metal permanganate with a preferred concentration of about 0.3% by weight. The temperature of the solution during the treatment of the oxidized or anodized aluminum is between 170° F. to about 212° F. or the boiling point of the solution.

The relatively high temperature is necessary to allow the permanganate to penetrate the oxide film. Also, the temperature appears to cause some swelling of the oxide film and permits the production of a mixed metal oxide film of manganese and aluminum oxide on the surface of the aluminum or aluminum alloys.

The upper concentration of the permanganate can be higher than the above indicated limit of 0.6%, but anything over this amount is not practical. The saturation limit of the permanganate is the upper limit of the concentration.

Other non-chromium compounds may be added to the permanganate solutions if desired, providing the compounds do not interfere with the desired corrosion resistant protection of the anodized aluminum or aluminum alloy surfaces.

The cleaning compounds for the aluminum or aluminum alloy surfaces are trichloroethane, sodium hydroxide, potassium hydroxide, alkaline solutions of sodium nitrate, hydrofluoric acid, sulfuric acid, nitric acid, sodium carbonate, sodium bromate, borax, and a commercial non-ionic surfactant polyoxyethylene or polyoxypropylene derivatives of organic acids, alcohols, alkylphenols or amines.

After cleaning the aluminum or aluminum alloy surfaces, the cleaned aluminum or aluminum alloy is anodized.

It is also recommended that neither the cleaning composition nor the corrosion resistant alkali metal permanganate composition contain a fatty acid, or any compound which would interfere with adhesion or formation of a protective coating on the anodized aluminum or aluminum alloy surface.

The following Examples 2–4 show that when our preferred limitations are not used, the panels have more pits than are generally desired.

EXAMPLE 1

A sheet of pure aluminum metal (3"×10") was degreased with trichloroethane, lightly etched in a 5% potassium hydroxide solution at 70° F. for two minutes, rinsed in de-ionized water, deoxidized in a 3% sodium bromate—10% nitric acid solution for five minutes at 100° F. and rinsed in de-ionized water for one minute. The aluminum was then anodized in a solution of 5% sulfuric acid and 1.0% boric acid at 80° F. for 20 minutes. The voltage was maintained at 15 volts and the current density at about 15 amps per square foot.

The anodized or oxidized aluminum sheet was rinsed in cold (70° F.–80° F.) de-ionized water for two minutes and further rinsed in warm (120° F.–130° F.) de-ionized water for five minutes. The anodized aluminum panel was then immersed in a 0.15% potassium permanganate solution at 190° F.–200° F. for 12 minutes followed by warm (120° F.–130° F.) water rinse for five minutes.

The dried permanganated treated anodized aluminum had on its surface a mixed coating of aluminum and manganese oxides. This permanganate treated anodized aluminum was then placed in a salt fog at 95° F. for 336 hours of exposure according to ASTM method B-117. The panel showed no noticeable pitting.

EXAMPLE 2

A sheet of pure aluminum (3"×10") was degreased with trichloroethane, lightly etched in a 5% potassium hydroxide solution at 70° F. for two minutes, rinsed in de-ionized water, deoxidized in a 3% sodium bromate—10% nitric acid solution for five minutes at 100° F. and rinsed in de-ionized water for one minute. The aluminum was then anodized in a solution of 5% sulfuric acid and 1.0% boric acid at 80° F. for 20 minutes. The voltage was maintained at 15 volts and the current density at about 15 amps per square foot.

The oxidized aluminum sheet was rinsed in cold (70° F.–80° F.) de-ionized water for two minutes and further rinsed in warm (120° F.–130° F.) de-ionized water for five minutes. The rinsed anodized sheet of aluminum was then immersed in a 0.10% potassium permanganate solution at 190° F.–200° F. for 12 minutes followed by a warm (120° F.–130° F.) water rinse for five minutes.

The dried permanganated treated anodized aluminum had on its surface a mixed coating of aluminum and manganese oxides. This permanganate treated anodized aluminum was then placed in a salt fog at 95% F for 336 hours of exposure according to ASTM method B117. The panel showed more than 15 pits.

EXAMPLE 3

A sheet of pure aluminum (3"×10") was degreased with trichloroethane, lightly etched in a 5% potassium hydroxide solution at 70° F. for two minutes, rinsed in de-ionized water, deoxidized in a 3% sodium bromate—10% nitric acid solution for five minutes at 100° F. and rinsed in de-ionized water for one minute. The aluminum was then anodized in a solution of 5% sulfuric acid and 1.0% boric acid at 80° F. for 20 minutes. The voltage was maintained at 15 volts and the current density at about 15 amps per square foot.

The anodized or oxidized aluminum sheet was rinsed in cold (70° F.–80° F.) de-ionized water for two minutes and further rinsed in warm (120° F.–130° F.) de-ionized water for five minutes. The aluminum was then immersed in a 0.70% potassium permanganate solution at 190° F.–200° F. for 12 minutes followed by a warm (120° F.–130° F.) water rinse for five minutes.

The dried permanganated treated anodized aluminum had on its surface a mixed coating of aluminum and manganese oxides. This permanganate treated anodized aluminum was then placed in a salt fog at 95° F. for 336 hours of exposure according to ASTM method B-117. The panel showed more than 15 pits.

EXAMPLE 4

A sheet of pure aluminum metal (3"×10") was degreased with trichloroethane, lightly etched in a 5% potassium hydroxide solution at 70° F. for two minutes, rinsed in de-ionized water, deoxidized in a 3% sodium bromate—10% nitric acid solution for five minutes at 100° F. and rinsed in de-ionized water for one minute. The aluminum was then anodized in a solution of 5% sulfuric acid and 1.0% boric acid at 80° F. for 20 minutes. The voltage was maintained at 15 volts and the current density at about 15 amps per square foot.

The oxidized aluminum sheet was rinsed in cold (70° F.–80° F.) de-ionized water for two minutes and further rinsed in warm (120° F.–130° F.) de-ionized water for five minutes. The anodized aluminum surface was then reacted with or "sealed" in a 0.15 potassium permanganate solution at 160° F. for 12 minutes followed by a warm (120° F.–130° F.) water rinse for five minutes.

The dried permanganated treated anodized aluminum had on its surface a mixed coating of aluminum and manganese oxides. This permanganate treated anodized aluminum was then placed in a salt fog at 95% F for 336 hours of exposure according to ASTM method B117. The panel showed more than 15 pits.

EXAMPLE 5

A sheet of pure aluminum metal (3"×10") was degreased with trichloroethane, lightly etched in a 5% potassium hydroxide solution at 70° F. for two minutes, rinsed in de-ionized water, deoxidized in a 3% sodium bromate—10% nitric acid solution for five minutes at 100° F. and rinsed in de-ionized water for one minute. The metal was then anodized in a solution of 5% sulfuric acid and 1.0% boric acid at 80° F. for 20 minutes. The voltage was maintained at 15 volts and the current density at about 15 amps per square foot.

The oxidized aluminum sheet was rinsed in cold (70° F.–80° F.) de-ionized water for two minutes and further rinsed in warm (120° F.–130° F.) de-ionized water for five minutes. The anodized aluminum surface was then immersed in a 0.15 potassium permanganate solution at 170° F. for 12 minutes followed by a warm (120° F.–130° F.) water rinse for five minutes.

The dried permanganated treated anodized aluminum had on its surface a mixed coating of aluminum and manganese oxides. This permanganate treated anodized aluminum was then placed in a salt fog at 95% F for 336 hours of exposure according to ASTM method B-117. The panel showed no noticeable pits.

EXAMPLE 6

A sheet of pure aluminum metal (3"×10") was degreased with trichloroethane, lightly etched in a 5% potassium hydroxide solution at 70° F. for two minutes, rinsed in de-ionized water, deoxidized in a 3% sodium bromate—10% nitric acid solution for five minutes at 100° F. and rinsed in de-ionized water for one minute. The aluminum was then anodized in a solution of 5% sulfuric acid and 1.0% boric acid at 80° F. for 20 minutes. The voltage was maintained at 15 volts and the current density at about 15 amps per square foot.

The oxidized aluminum sheet was rinsed in cold (70° F.–80° F.) de-ionized water for two minutes and further rinsed in warm (120° F.–130° F.) de-ionized water for five minutes. The anodized aluminum surface was then immersed in a 0.15% potassium permanganate solution at 212° F. for 12 minutes followed by a warm (120° F.–130° F.) water rinse for five minutes.

The dried permanganated treated anodized aluminum had on its surface a mixed coating of aluminum and manganese oxides. This permanganate treated anodized aluminum was then placed in a salt fog at 95% F for 336 hours of exposure according to ASTM method B117. The panel showed no noticeable pits.

EXAMPLE 7

A sheet of "2024-T3 aluminum alloy (3"×10") was degreased with trichloroethane, lightly etched in a 5% potassium hydroxide solution at 70° F. for two minutes, rinsed in de-ionized water, deoxidized in a 3% sodium bromate—10% nitric acid solution for five minutes at 100° F. and rinsed in de-ionized water for one minute. The aluminum alloy was then anodized in a solution of 5% sulfuric acid and 1.0% boric acid at 80° F. for 20 minutes. The voltage was maintained at 15 volts and the current density at about 15 amps per square foot.

The oxidized aluminum alloy sheet was rinsed in cold (70° F.–80° F.) de-ionized water for two minutes and further rinsed in warm (120° F.–130° F.) de-ionized water for five minutes. The anodized aluminum alloy surface was then immersed in a 0.3% potassium permanganate solution at 190° F.–200° F. for 12 minutes followed by a warm (120° F.–130° F.) water rinse for five minutes.

The dried permanganated treated anodized aluminum had on its surface a mixed coating of aluminum and manganese oxides. This permanganate treated anodized aluminum was then placed in a salt fog at 95% F for 336 hours of exposure according to ASTM method B-117. The panel showed no pits.

EXAMPLE 8

A sheet of "2024-T3 aluminum alloy (3"×10") was degreased with trichloroethane, lightly etched in a 5% potassium hydroxide solution at 70° F. for two minutes, rinsed in de-ionized water, deoxidized in a 3% sodium bromate—10% nitric acid solution for five minutes at 100° F. and rinsed in de-ionized water for one minute. The aluminum was then anodized in a solution of 5% sulfuric acid and 1.0% boric acid at 80° F. for 20 minutes. The voltage was maintained at 15 volts and the current density at about 15 amps per square foot.

The oxidized aluminum alloy sheet was rinsed in cold (70° F.–80° F.) de-ionized water for two minutes and further rinsed in warm (120° F.–130° F.) de-ionized water for five minutes. The anodized aluminum alloy surface was then immersed in a 0.5% potassium permanganate solution at 190° F.–200° F. for 12 minutes followed by a warm (120° F.–130° F.) water rinse for five minutes.

The dried permanganated treated anodized aluminum had on its surface a mixed coating of aluminum and manganese oxides. This permanganate treated anodized aluminum was then placed in a salt fog at 95% F for 336 hours of exposure according to ASTM method B-117. The panel showed no pits.

EXAMPLE 9

A sheet of "2024-T3 aluminum alloy (3"×10") was degreased with trichloroethane, lightly etched in a 5% potassium hydroxide solution at 70° F. for two minutes, rinsed in de-ionized water, deoxidized in a 3% sodium bromate—10% nitric acid solution for five minutes at 100° F. and rinsed in de-ionized water for one minute. The aluminum alloy was then anodized in a solution of 5% sulfuric acid and 1.0% boric acid at 80° F. for 20 minutes. The voltage was maintained at 15 volts and the current density at about 15 amps per square foot.

The oxidized aluminum alloy sheet was rinsed in cold (70° F.–80° F.) de-ionized water for two minutes and further rinsed in warm (120° F.–130° F.) de-ionized water for five minutes. The anodized aluminum alloy surface was then immersed in a 0.6% potassium permanganate solution at 190° F.–200° F. for 12 minutes followed by a warm (120° F.–130° F.) water rinse for five minutes.

The dried permanganated treated anodized aluminum had on its surface a mixed coating of aluminum and manganese oxides. This permanganate treated anodized aluminum was then placed in a salt fog at 95% F for 336 hours of exposure according to ASTM method B-117. The panel showed no pits.

Our Examples show protecting anodized aluminum or aluminum alloys with a non-chromium permanganate. Therefore, my process eliminates the toxicity of chromium compositions generally used for this purpose and are therefore more environmentally effective.

I claim:

1. A method of protecting an aluminum or aluminum alloy which has not been treated with chromium and which has been anodized by electrolysis to provide an anodized aluminum or aluminum alloy comprising preparing a non-chromium alkali metal permanganate solution having a pH in the range of about 4.0 to about 8.0, heating the solution to a temperature of from about 170° F. to about 212° F., rinsing said anodized aluminum or aluminum alloy with warm water to warm said anodized aluminum or aluminum alloy, coating said warm anodized aluminum or aluminum alloy with said permanganate solution, and forming a non-chromium mixed metal oxide coating of aluminum and manganese oxides on the anodized aluminum or aluminum alloy.

2. The method of claim 1 wherein said alkali metal is selected from the group consisting of sodium and potassium.

3. The method of claim 2 wherein the concentration of permanganate in said solution is in the range of 0.15 to 0.6% by weight and the article is immersed in sand solution to provide the mixed oxide coating.

4. A process of providing aluminum or aluminum alloy with a corrosion resistant protective coating comprising cleaning said aluminum or aluminum alloy, anodizing by electrolysis the cleaned aluminum or aluminum alloy with a non-chromium compound, contacting the anodized aluminum or aluminum alloy with a non-chromium permanganate solution containing at least 0.15 % by weight of alkali metal permanganate, a pH range of about 4 to about 8, and a temperature of about 170° F. to the boiling point of the solution to provide a non-chromium corrosion resistant protective coating of mixed oxides of aluminum and manganese.

5. The process of claim 4 wherein the aluminum or aluminum alloy is degreased with trichloroethane, lightly etched with a potassium hydroxide solution, deoxidized with a solution of sodium bromate and nitric acid and anodized in a solution of sulfuric acid and boric acid.

6. The method of claim 4 wherein the alkali metal is selected from the group consisting of sodium and potassium.

7. The method of claim 5 wherein the alkali metal is selected from the group consisting of sodium and potassium.

* * * * *